United States Patent [19]

Wunderlich

[11] 4,182,674

[45] Jan. 8, 1980

[54] NITROGEN REDUCTION AND DEHYDROGENATION OF SYNTHETIC CRUDE

[75] Inventor: Donald K. Wunderlich, Richardson, Tex.

[73] Assignee: Atlantic Richfield Company, Los Angeles, Calif.

[21] Appl. No.: 16,452

[22] Filed: Feb. 28, 1979

[51] Int. Cl.[2] ..... C10G 23/00; C07C 5/32

[52] U.S. Cl. ..... 208/89; 208/254 H

[58] Field of Search ..... 208/254 H, 89

[56] References Cited

U.S. PATENT DOCUMENTS

| | | | |
|---|---|---|---|
| 2,839,449 | 6/1958 | MacPherson et al. | 208/89 |
| 3,228,993 | 1/1966 | Kozlowski et al. | 208/254 H |
| 3,297,565 | 1/1967 | Garwood et al. | 208/254 H |
| 3,567,624 | 3/1971 | Pfefferle | 208/89 |

*Primary Examiner*—George Crasanakis

*Attorney, Agent, or Firm*—Roderick W. MacDonald

[57] ABSTRACT

A method for reducing the nitrogen content of a feed stream derived from oil shale and/or coal comprising hydrodenitrogenating the feed stream, subjecting the hydrodenitrogenated feed stream to first flashing conditions to remove hydrogen, hydrogen sulfide, and ammonia, dehydrogenating the remainder of the feed stream, and subjecting the dehydrogenated feed stream to second flashing conditions to separate hydrogen from the process product.

5 Claims, 1 Drawing Figure

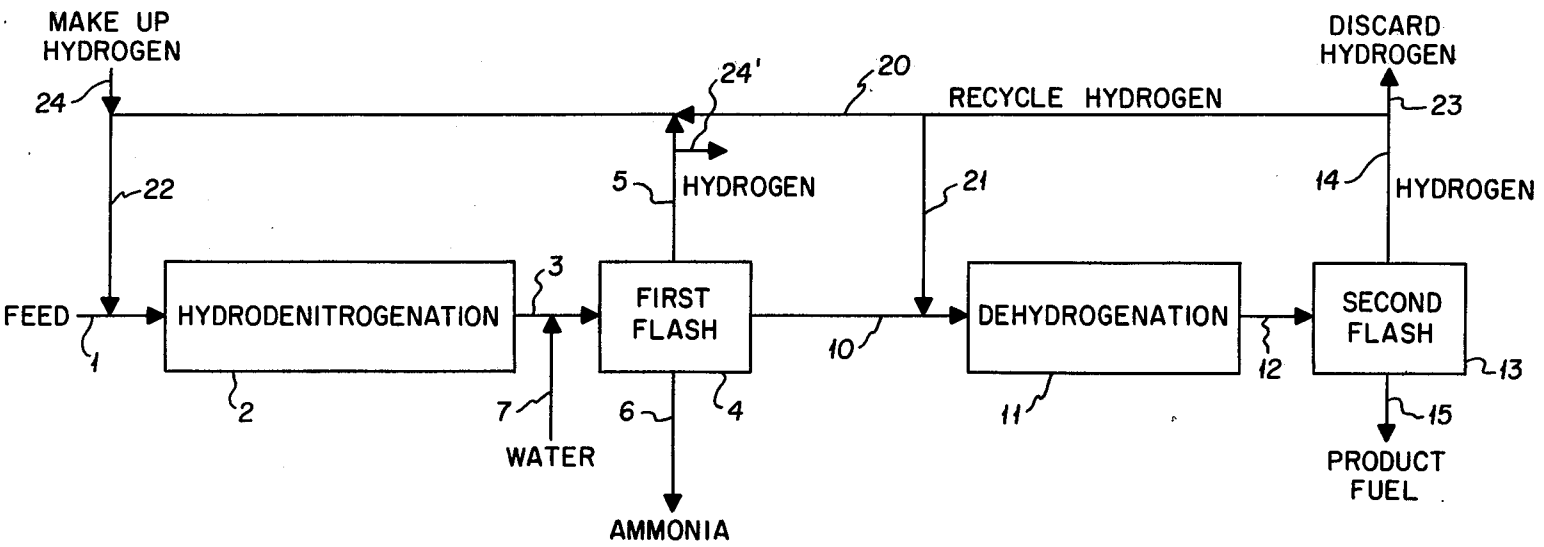
MAKE UP HYDROGEN
24
22
FEED
1
HYDRODENITROGENATION
2
3
WATER
7
FIRST FLASH
4
6
AMMONIA
5
HYDROGEN
24'
20
RECYCLE HYDROGEN
21
10
DEHYDROGENATION
11
12
SECOND FLASH
13
15
PRODUCT FUEL
14
HYDROGEN
DISCARD HYDROGEN
23

NITROGEN REDUCTION AND DEHYDROGENATION OF SYNTHETIC CRUDE

BACKGROUND OF THE INVENTION

Liquid hydrocarbons obtained from oil shale or normally solid coal are usually low in sulfur content and, therefore, are good candidates for use as a fuel, for example, in steam boilers. However, such synthetic crude feed streams sometimes have a nitrogen content, primarily in the form of organic nitrogen, which is higher than is desired for fuel.

Prior art processes for reducing the nitrogen content of such synthetic crude materials use up large amounts of expensive hydrogen. Hydrogen take up to saturate olefins, aromatics, etc., in the feed stream is not necessary for fuel stocks.

SUMMARY OF THE INVENTION

According to this invention there is provided a process for reducing the nitrogen content of a feed stream derived from oil shale and/or coal while minimizing net hydrogen consumption. This invention provides a process product which is suitable for use as fuel but not unduly expensive because of needless hydrogen consumption during processing.

Accordingly, it is an object of this invention to provide a new and improved process for reducing the nitrogen content of an oil shale or coal derived synthetic crude material. It is another object to provide a new and improved method for producing a synthetic fuel which is satisfactorily low in nitrogen and which has not consumed more than the necessary amount of hydrogen to produce a satisfactory fuel.

Other aspects, objects and advantages of this invention will be apparent to those skilled in the art from this disclosure and the appended claims.

BRIEF DESCRIPTION OF THE DRAWINGS

The drawing showed a fuel scheme which represents one embodiment within this invention.

DETAILED DESCRIPTION OF THE INVENTION

More specifically, the drawing shows the feed stream passing by way of pipe 1 into a conventional hydrodenitrogenation unit 2.

The feed stream for this invention is derived from oil shale and/or normally solid coal and can be a full range material or one or more cuts from a full range material, as well as various blends of materials.

Hydrodenitrogenation unit 2 is a conventional unit which uses severe operating conditions such as the temperature of at least 600° F., preferably from about 700° to about 800° F., a high hydrogen partial pressure of at least 500 psig, preferably from about 1,500 to about 2,000 psig, a catalyst, and a high ratio of catalyst to feed rate, for example, at least 1 to 4 hours. Suitable catalysts that can be employed are nickel-molybdenum on alumina, nickel-molybdenum-phosphorous on alumina, cobalt-molybdenum on alumina, cobalt-molybdenum-phosphorous on alumina, nickel-tungsten on alumina, and the like.

Under normal hydrodenitrogenation conditions, large amounts of hydrogen are consumed by the feed stream. Some of the hydrogen is employed to convert nitrogen to ammonia, sulfur to hydrogen sulfide, and oxygen to water. However, a large amount of hydrogen is consumed by unsaturated organic materials in the feed stream. For example, it is taken up in saturating olefins and converting aromatics to more saturated materials such as naphthalenes.

The nitrogen content of the feed stream in pipe 1 will vary widely but is oftentimes greater than 0.15 weight percent nitrogen based on the total weight of the feed stream and sometimes as high as 2 weight percent nitrogen or more. It is preferable that the nitrogen content of a fuel be less than about 0.5 weight percent, and, therefore, a substantial amount of hydrogen is used up in converting nitrogen and sulfur into removable chemical entities.

However, the hydrogen consumed in saturating olefins, aromatics, and the like in the feed stream is not necessary to provide a useful fuel. Such saturation provides essentially nothing beneficial for the fuel product itself but does add a considerable incremental expense for the fuel. In accordance with this invention at least part of the hydrogen consumed in saturating olefins, aromatics, and the like in the hydrodenitrogenation unit 2 is recovered thereby providing a satisfactory fuel at a lower unit cost.

In accordance with this invention the hydrodenitrogenated material from unit 2 is passed by way of pipe 3 to a first flash zone 4 wherein the hydrodenitrogenated feed stream is subjected to first flashing conditions which primarily separate hydrogen, hydrogen sulfide, and ammonia from the feed stream. The hydrogen is recovered overhead by way of pipe 5. The ammonia is separately recovered by way of pipe 6. Normally there is not sufficient water present in the feed stream to absorb the ammonia and any hydrogen sulfide formed in unit 2. Water can be added by way of pipe 7 if desired.

First flashing conditions in unit 4 can vary widely so long as at least hydrogen and ammonia are effectively removed from the feed stream. Preferable conditions include a pressure which is essentially the same pressure as that present in hydrodenitrogenation unit 2 and a temperature which is substantially below the operating temperature of unit 2. Such a temperature is preferably in the range of from about 80° to about 120° F.

The liquid feed stream now substantially reduced in both sulfur and nitrogen, is removed from flash unit 4 by way of pipe 10 and passed to dehydrogenation zone 11. Zone 11 is run under conditions which remove additional hydrogen from the feed stream including some hydrogen which was consumed in unit 2 by the aforesaid saturation process.

The operating conditions on unit 11 can vary widely but generally include a temperature of at least about 800° F., preferably from about 900° to about 950° F., and a pressure of at least 1 to 4 atmosphere, preferably from about 1 atmosphere to about 200 psig. The process is preferably catalytic, uses a catalyst to feed rate of at least 1 to 8 hours, and conventional catalysts such as nickel-molybdenum on alumina, cobalt-molybdenum on alumina, molybdenum on alumina, nickel on alumina, and the like. Unit 11 can employ a fixed bed of catalysts in which case a battery of catalytic beds will be employed so that one or more beds can be in use while one or more other beds are being regenerated, or can employ a fluidized catalytic bed whereby continuous catalytic regeneration of a side stream can be practiced if desired. The main point is that unit 11 removes hydrogen from the feed stream thereby introducing unsaturation back into the feed stream which was removed by hydrogen consumption in unit 2. Expensive hydrogen is recovered in the unsaturation process of unit 11. Some unsaturation is not detrimental to the use of the feed stream as fuel, and the hydrogen so recovered can be recycled and reused thereby keeping the unit cost for the fuel product of this invention as low as possible.

The dehydrogenation feed stream passes from unit 11 by way of pipe 12 into second flash zone 13 wherein it is subjected to second flashing conditions which separate hydrogen from the process product. The separated hydrogen is recovered by way of pipe 14 while the liquid product fuel of this invention is recovered by way of pipe 15 for further processing, sale, or other disposition as desired.

Hydrogen is recovered by way of both pipes 5 and 14 for recycling in the process by way of pipe 20, for example, upstream of unit 11 by way of pipe 21 and/or upstream of unit 2 by way of pipe 22.

Of course, some hydrogen can be removed from the system by way of pipe 23 and/or pipe 24, if desired, and make-up hydrogen can be introduced to the system by way of pipe 24 if necessary.

The process product in pipe 15 is reduced in nitrogen content to the extent desired to make the product in pipe 15 useful as a fuel but the product in pipe 15 is not fully saturated, the hydrogen which would have fully saturated the feed stream having been recovered for use in the process.

Second flashing conditions can vary widely so long as hydrogen is separately recovered, but preferably will include a pressure which is essentially the same as the pressure in dehydrogenation unit 11 and a temperature which is substantially below the temperature of dehydrogenation unit 11, for example, in the range of from about 80° to about 120° F.

EXAMPLE

A shale oil feed stream obtained by retorting Colorado oil shale and having a boiling range of from about 400° to about 950° F. was processed essentially in accordance with the scheme shown in the drawing.

The feed stream was first subjected to hydrodenitrogenation at a temperature of 700° F., a pressure of 2,000 psig, a nickel molybdenum on alumina catalyst, and a ratio of catalyst to feed rate of 2 hours.

The feed stream originally contained 2.17 weight percent nitrogen based on the total weight of the feed stream.

After hydrodenitrogenation, the feed stream was subjected to first flashing conditions which comprised a temperature of about 100° F. and a pressure of 2,000 psig. Elemental hydrogen was recovered overhead from the first flash unit and ammonia and hydrogen sulfide in the form of ammonia sulfide dissolved in liquid water were recovered separately thereby leaving a remainder feed stream to be subjected to dehydrogenation conditions.

Dehydrogenation unit 11 was run to about 900° F., and about 14.7 psig using a nickel molybdenum on alumina catalyst, and a ratio of catalyst to feed rate of 0.25 hours.

The feed stream output of the dehydrogenation unit was then subjected to second flashing conditions of about 100° F. and 14.7 psig.

Elemental hydrogen was recovered from second flash unit 13 separately from the liquid product fuel of that unit. The liquid product fuel had a nitrogen content of about 0.05 weight percent based on total weight of the fuel product.

The elemental hydrogen separately recovered from both the first and second flash units was suitable for reuse in either the hydrodenitrogenation unit or the dehydrogenation unit or both.

Reasonable variations and modifications are possible within the scope of this disclosure without departing from the spirit and scope of this invention.

The embodiments of the invention in which an exclusive property or privilege is claimed are defined as follows:

1. A method for reducing the nitrogen content of a liquid feed stream derived from at least one of oil shale and coal comprising hydrodenitrogenating said feed stream, subjecting said hydrodenitrogenated feed stream to first flashing conditions to separate primarily hydrogen, hydrogen sulfide, and ammonia from said feed stream, dehydrogenating the flashed denitrogenated feed stream, and subjecting said dehydrogenated feed stream to second flashing conditions to separate hydrogen from the process product liquid.

2. The method according to claim 1 wherein said first flashing conditions include a pressure which is essentially the same as the hydrodenitrogenation pressure and a temperature substantially below the hydrodenitrogenation temperature, and said second flashing conditions include a pressure which is essentially the same as the dehydrogenation pressure and a temperature substantially below the dehyrogenation temperature.

3. The method according to claim 2 wherein the temperature of each of said first and second flashing conditions is in the range of from about 80° to about 120° F.

4. The method according to claim 2 wherein said hydrodenitrogenation step is catalytic and carried out under conditions which include a temperature of at least about 600° F. and a pressure of at least 500 psig, and said dehydrogenation step is catalytic and carried out under conditions which include a temperature of at least about 800° F. and a pressure up to 200 psig.

5. The method according to claim 1 wherein water is added prior to said first flashing step so that the ammonia is removed as ammonium sulfide dissolved in essentially liquid water.

* * * * *